US009635899B2

(12) United States Patent
Sashen

(10) Patent No.: US 9,635,899 B2
(45) Date of Patent: May 2, 2017

(54) SANDAL STRAP ARRANGEMENT AND TENSIONING SYSTEM

(71) Applicant: Steven Sashen, Boulder, CO (US)

(72) Inventor: Steven Sashen, Boulder, CO (US)

( * ) Notice: Subject to any disclaimer, the term of this patent is extended or adjusted under 35 U.S.C. 154(b) by 432 days.

(21) Appl. No.: 14/522,298

(22) Filed: Oct. 23, 2014

(65) Prior Publication Data

US 2016/0113350 A1 Apr. 28, 2016

(51) Int. Cl.
*A43B 3/12* (2006.01)

(52) U.S. Cl.
CPC ..... *A43B 3/126* (2013.01); *A43B 3/122* (2013.01)

(58) Field of Classification Search
CPC ..... A43B 3/12; A43B 3/122; A43B 3/126
USPC ..... 36/11.5
See application file for complete search history.

(56) References Cited

U.S. PATENT DOCUMENTS 1,463,672 A * 7/1923 Carrington ..... A43B 3/12 36/11.5
D62,905 S * 8/1923 Hamilton ..... 36/11.5
4,297,798 A * 11/1981 Colan ..... A43B 3/24 36/101
6,516,538 B2 * 2/2003 Kraft ..... A43B 3/126 36/101
8,020,319 B1 * 9/2011 Mohaupt ..... A43B 3/122 36/101
8,813,386 B2 * 8/2014 Pucci ..... A43B 3/122 36/100
9,510,638 B2 * 12/2016 McDonald ..... A43B 3/126
2002/0116840 A1 * 8/2002 Kraft ..... A43B 3/126 36/11.5
2007/0204483 A1 * 9/2007 Kirsch ..... A43B 3/24 36/11.5
2012/0204441 A1 * 8/2012 Conner ..... A43B 3/103 36/11.5
2013/0160326 A1 * 6/2013 Szekeresh ..... A43B 7/32 36/102
2014/0144048 A1 * 5/2014 McDonald ..... A43B 3/126 36/103
2016/0007673 A1 * 1/2016 McDonald ..... A43B 3/126 36/11.5

* cited by examiner

*Primary Examiner* — Marie Bays
(74) *Attorney, Agent, or Firm* — J. Todd Rushton

(57) ABSTRACT

A sandal having two independent support straps that are joined over the metatarsal region of the foot and tensioned, over the top of the foot and around the ankle of the user, posterior to the connection point.

12 Claims, 9 Drawing Sheets

SANDAL STRAP ARRANGEMENT AND TENSIONING SYSTEM

SUMMARY OF THE INVENTION

The present invention is a sandal having two independent support straps that are joined over the metatarsal region of the foot and tensioned posterior to the strap junction. The two independent straps allow the user to easily modify the lace/webbing geometry and tension across the metatarsal region, around the ankle, and around the heel, for optimal support and comfort. The user can adjust the positon of the junction of the independent support straps to improve comfort over the metatarsal region of the foot and to change the alignment of the strap portion that extends between the user's toes. Tension adjustment is at the rear of the foot, rather than on top of the metatarsals, creating a more aesthetically pleasing strap configuration, knots or hardware are behind the foot to avoid being bumped or pressed into the users skin; and in several embodiments the knots or hardware can be moved to different positions around the user's heel or Achilles to improve comfort.

A first embodiment of the present invention includes a pre-formed sandal sole having an integrated heel cup, elevated side lace attachment tabs and a thong strap attachment hole through the sole, proximate the location of the gap between the users first and second toes. A first strap extending through the thong strap attachment hole and secured at the bottom of the sole, the free end inserted through a hole formed in the side lace attachment tab on the lateral side of the sandal sole, the strap inserted from the top surface and then immediately routed from the bottom surface, back around the edge portion of the sole and inside of the portion of first strap that extends into the tab and then extended to the rear heel cup area of the sandal sole. A second strap is attached to the first strap just above the attached end of the first strap and proximate the metatarsal region of the Users foot. The second strap inserted through the side lace attachment tab on the medial side of the sandal sole, and likewise the free end is wrapped back to the top surface of the sole, around the running portion of the strap and extended toward the heel cup of the sole. The free ends of the first and second straps are adjustably joined or coupled proximate the heel cup of the sole to comfortably engage the Achilles region of the users' foot. In one embodiment the first strap is secured under the bottom surface of the sole by tying an overhand or surgeons knot and then partially melting the knot to fuse the overlaying strap portions together. The knot and partially melted strap portion is pressed against hard surface to flatten the knot which increases user comfort and improves the wear rate on the knot. In another embodiment an injection molded button is used to secure the first strap to the sole. In one embodiment the second strap is attached to the first strap at the metatarsal region using a knot. In another embodiment, the second strap is doubled over forming a loop, which is wrapped around the first strap, and the free ends of the second strap are extended through the loop forming a clinch around the first strap. In another embodiment, the second strap includes a loop end through which the first strap is inserted. In another embodiment, the second strap is sewn to the first strap proximate the metatarsal region of the users foot. In yet another embodiment , the second strap is secured to the first strap using a hardware piece, such as a, ring, buckle, ladder-lock as known in the art, or modified hardware as developed for a perpendicular attachment application. Some hardware arrangements create a fixed attachment point of the second strap to the first strap, other hardware arrangement create a moveable attachment point between the first strap and the second strap. A moveable attachment point between the first strap and second strap allows the user to move the attachment point and corresponding knot or hardware to a more comfortable position on the foot or to create tension allowing angular adjustment of the toe strap or toe post. In one embodiment the routing of the first and second straps is reversed, the first strap extending from the toe attachment hole to the medial side attachment tab and the second strap extending from the connection with the first strap to the lateral side attachment tab. In another embodiment the first strap connects to the sole proximate the gap between the users' first and second toes but does not extend through the sole to the bottom and is anchored in an intermediate layer of the sole.

The adjustable junction or coupling of the free ends of the first and second straps can be accomplished in a first embodiment using an overhand or fisherman's knot. This is accomplished by extending the free end of the first strap over the running portion of the second strap and forming an overhand knot of the second strap. Conversely, the second strap is extended over the running portion of the first strap and an overhand knot is formed in the free end of the second strap over the running portion of the first strap. Once the knots are tied the excess is trimmed away and the knots can be moved along the running portion of the opposing strap allowing the user to tension the strap system. In another embodiment the adjustable junction is formed using a ladder lock hardware secured on the running portion of each strap and having the free ends of the opposing strap adjustably inserted through the ladder lock. In another embodiment a cushion cover sleeve or tube is placed over the overlapping portion of the first and second straps and between the ladder lock hardware. In another embodiment the first and second straps are secured using a spring loaded barrel lock or similar mechanism. In another embodiment, an independent heel strap or pad, designed to comfortably engage the rear of the user's foot, is used at the adjustable junction between the first and second straps. The heel strap including hardware pieces which allow the free ends of the first strap and second straps to adjustably attach. In yet another embodiment the adjustable connection is accomplished using a hook and loop fastener such as Velcro®.

In another embodiment of the present invention the sandal sole has a recess formed to receive a pre-formed toe-post. A toe-post is formed using durable elastomeric material that resists wear when in contact with the ground, but is also supple enough to provide a reasonable level of comfort for the user. The toe-post is designed having a base lug portion that securely engages the recess formed in the bottom of the sole, the post that extends through the sole forms an arcuate structure that is positioned between the users first and second toes. The terminal end of the toe-post includes an aperture or opening where first strap is attached.

In another embodiment the toe-post is formed using an independent strap section having a sole connection button or lug and a loop or aperture formed in the free for connecting the first strap.

In one embodiment the first strap and second straps are single straps, laces. In another embodiment the first strap is formed using single strap or lace and the second strap is formed using a single strap or lace double back over itself, essentially forming two parallel straps or laces that extend to the heel portion of the sole. In another embodiment both the first strap and second strap including doubled over or parallel straps that extend toward the heel portion of the sole.

It contemplated that the straps can be such material as cordage formed from material such as natural fiber, hemp, jute, cotton or leather, or the cordage may be a material such as nylon or polypropylene. It is also contemplated that the straps can be flat material such as leather straps or formed using webbing material.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAILED DESCRIPTION OF THE INVENTION

Figure 1:
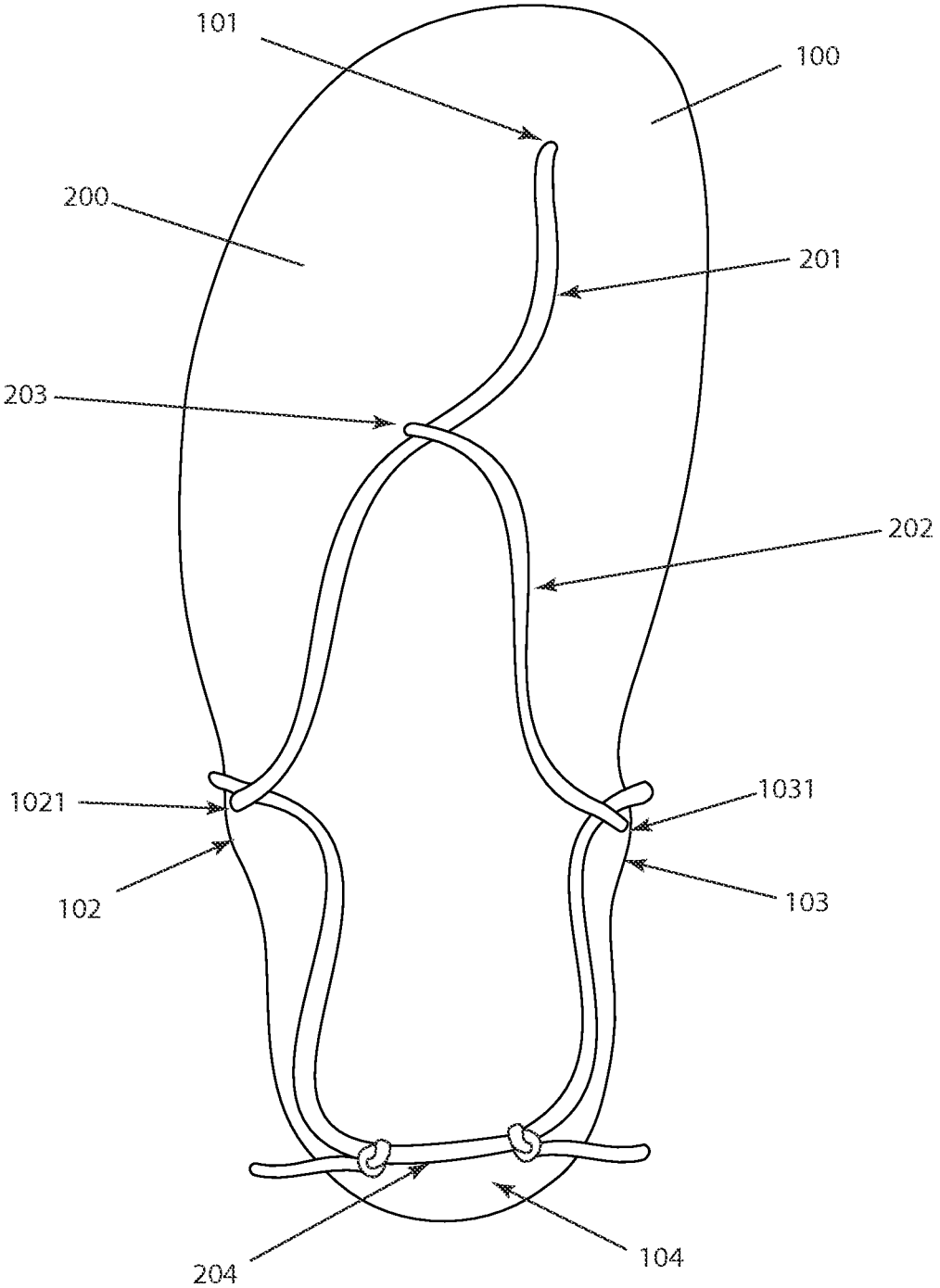
FIG. 1 illustrates a top view of a sandal of the present invention.

For the purposes of promoting an understanding of the principles in accordance with the disclosure, reference will be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

As used in this specification and the appended claims, the singular forms "a," "an," and "the" include plural referents unless the context clearly dictates otherwise. In describing and claiming the present disclosure, the following terminology will be used in accordance with definitions set out below. The term sole refers to the base portion of the sandal. The term strap refers to cord, cordage or webbing used for fastening the sandal to the user's foot. The cordage may be, but not limited to, a natural material such as cotton, hemp, jute or leather or a synthetic material such as nylon or polypropylene.

As used herein, the terms "comprising," "including," "containing," "characterized by," and the grammatical equivalents thereof are inclusive or open-ended terms that do not exclude additional, unrecited elements or method processes.

Illustrated in FIGS. 1 through 9 are first embodiment of the present invention or sandal strap arrangement and tensioning system. The sandal platform including a sole portion 100 having a toe strap hole 101, lateral side lace attachment tab 102, medial side lace attachment tab 103 and integrated heel cup 104. The first embodiment of the strap arrangement 200 of the present invention includes a first strap portion 201 inserted through the toe strap hole 101 and secured on the bottom surface of the sandal sole 100. The free end of first strap 201 extends from the toe strap hole 101 to the lateral side lace attachment tab 102 and is inserted into hole 1021, the free end is immediately reversed around the edge of sole 100 and wrapped behind the running potion just prior to the entry point of hole 1021 and extended toward the heel cup 104 at the rear of sole 100. The second strap 202 is attached to first strap 201 above toe hole 101 and proximate the metatarsal region of the user's foot forming attachment point 203. In one embodiment attachment point 203 is movable or sliding, in another embodiment attachment point 203 is fixed using knots, sewing or hardware. The free end of the second strap portion 202 is extended toward the medial side attachment tab 103 and inserted through hole 1031. The free end is reversed around the edge of sole 100 and around the running portion of the second strap 202 and extended to the rear of sole 100 proximate the heel cup 104. The free ends of the first strap 201 and the second strap 202 are secured together in an adjustable attachment 204 configuration proximate the Achilles region of the user's foot. As shown in FIG. 1 the adjustable attachment configuration 204 is formed using an overlapping fisherman's knot formed using the free ends of the first strap 201 and the second strap 202.

Figure 2:
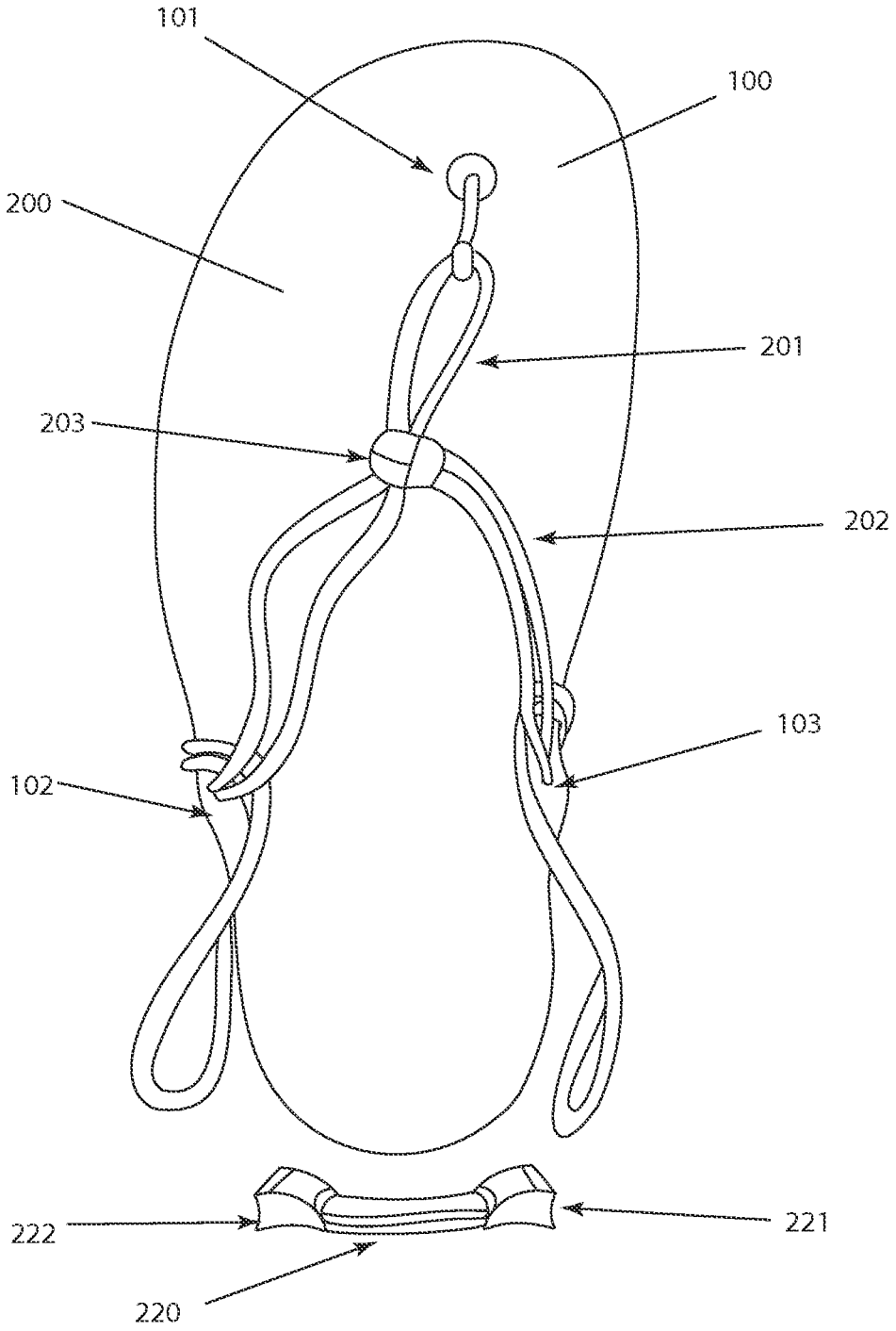
FIG. 2 illustrates a top view of a sandal of the present invention having an independent heel strap.
Figure 3:
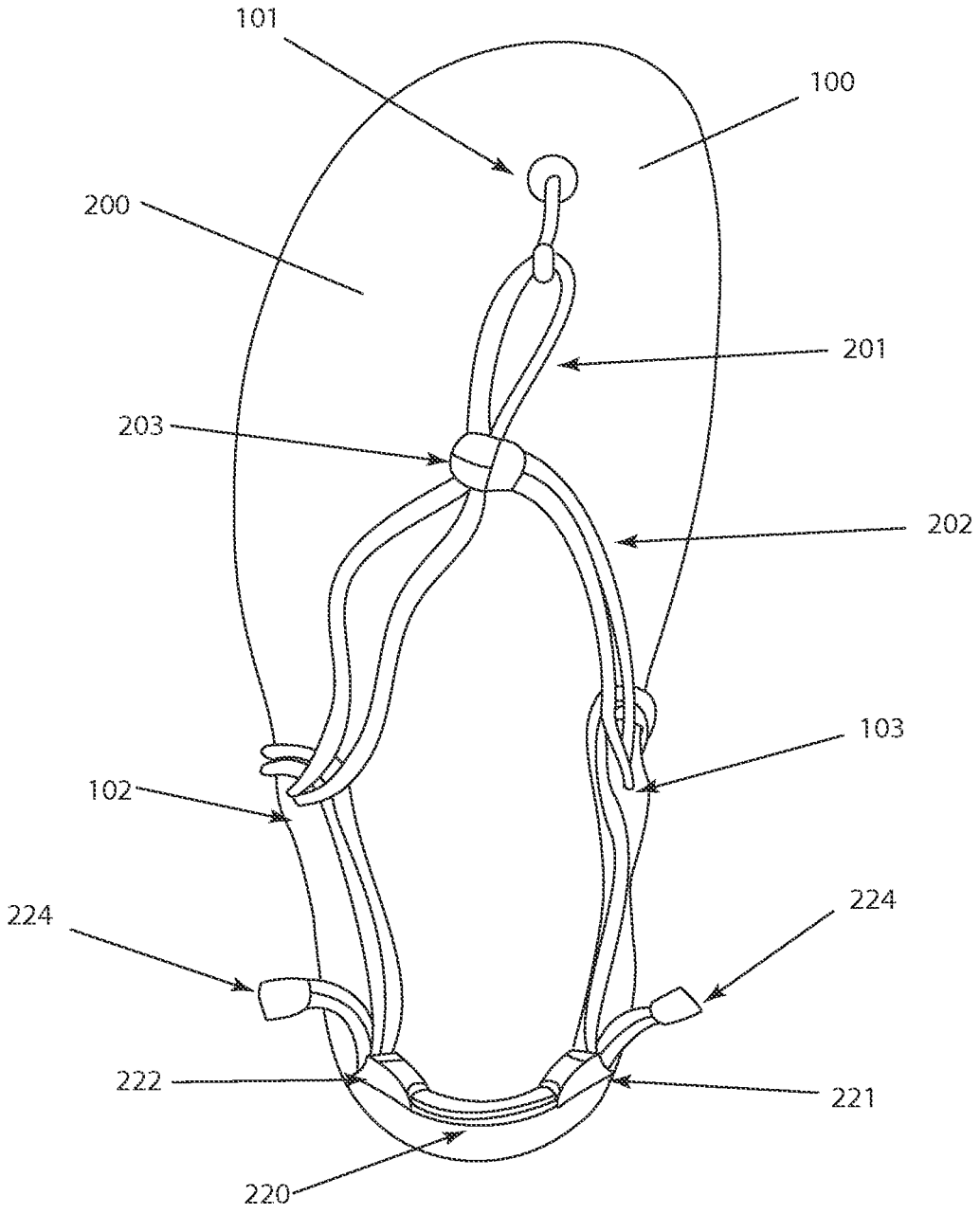
FIG. 3 illustrates a top view of a sandal of the present invention having an independent heel strap.

Shown in FIGS. 2 and 3 includes an independent toe post 110 attached through a recess formed proximate the toe strap attachment hole 101. A lacing aperture is formed in the end of toe post 110 wherein providing an attachment point for the first strap portion 201. An independent heel strap portion 220 is shown detached in FIG. 1 and attached in FIG. 2. Heel strap portion includes tensioning hardware 221 and 222 where the free ends of the first strap 201 and second straps 202 are laced. In this embodiment the user can adjust the position of the adjustable attachment 204 by tensioning or loosening the straps 201 and 200 extended through hardware 221 and 222. This allows the user's having different bone structure or size to move hardware 221 and 222 or adjustable attachment 204 into a more comfortable location on the heel or away from any boney protuberances. FIG. 3 including a pull tab 224 attached to the free ends of the first strap 201 and the second strap 202.

Figure 4:
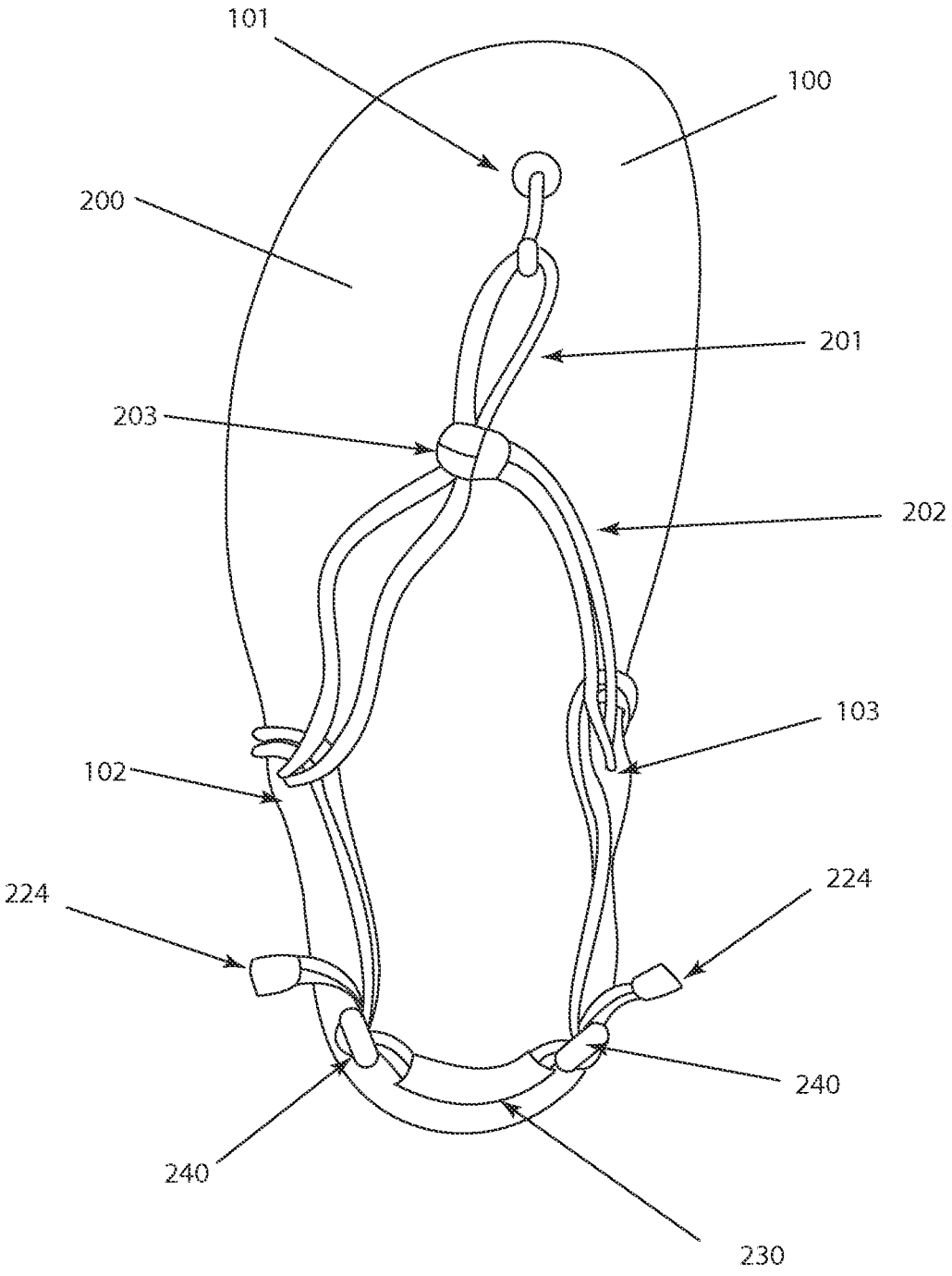
FIGS. 4 illustrates a top view of a sandal of the present invention having a tubular heel pad.

In one embodiment, shown in FIG. 4 the overlap formed between the first strap 201 and the second strap 202 in covered using a silicon tube or pad 230 to protect the user's Achilles area. Ladder lock hardware 240 may be used for strap tension adjustment.

Figure 5:
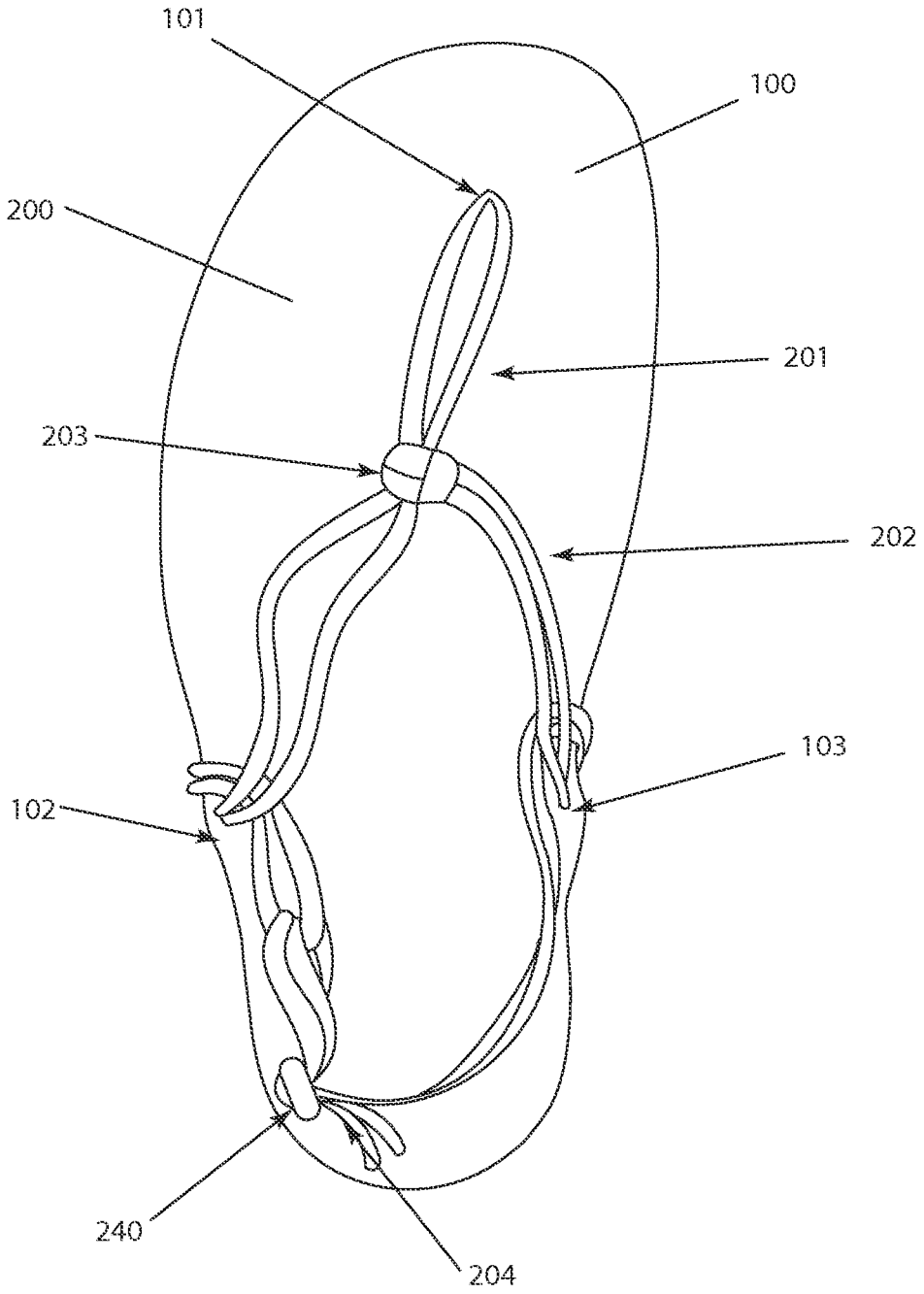
FIG. 5 illustrates a top view of a sandal of the present invention having a single rear tensioning point.
Figure 6:
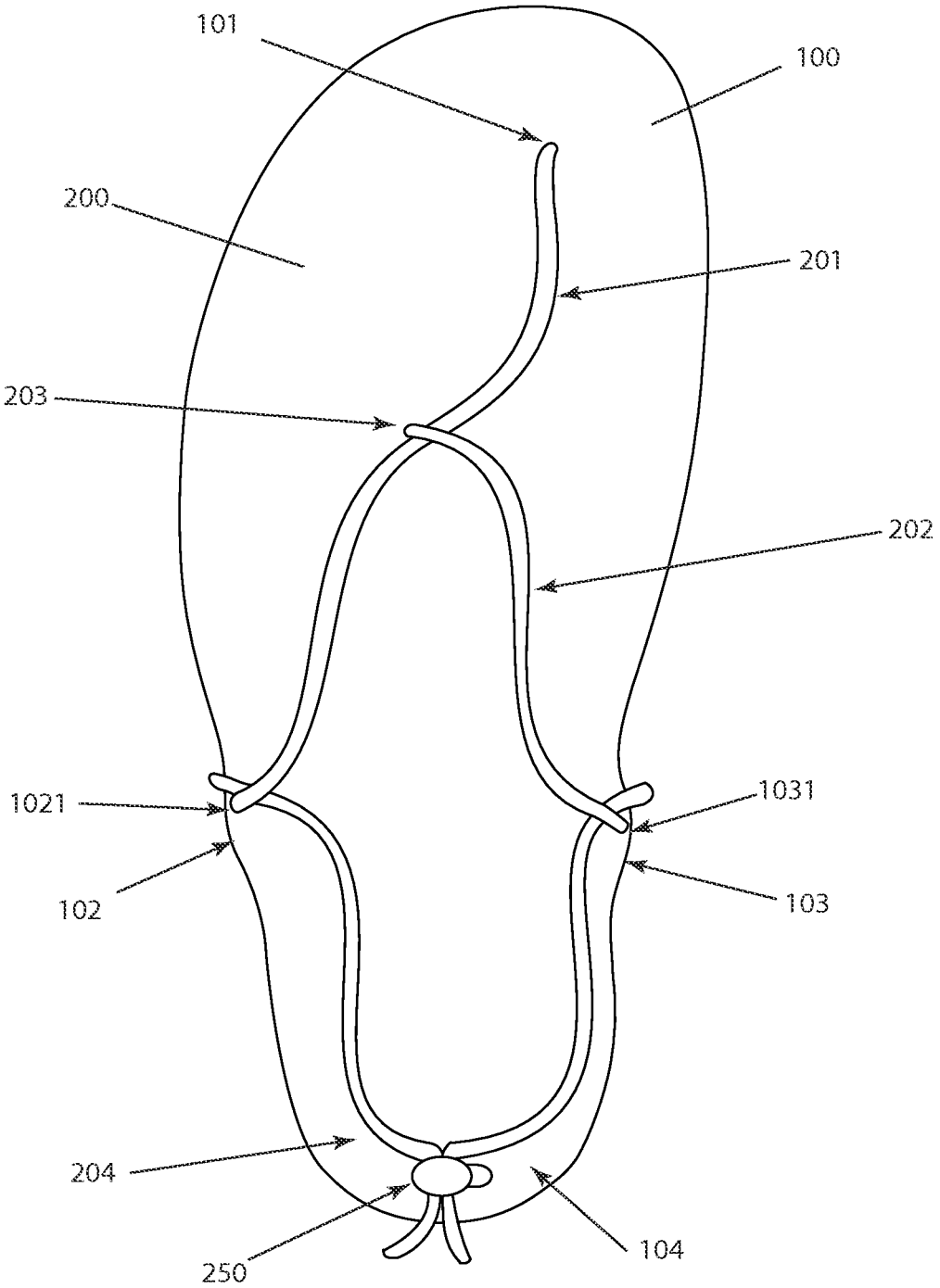
FIG. 6 illustrates a top view of a sandal of the present invention having a single barrel lock for rear tensioning.

FIGS. 5 and 6 show embodiments including a single point adjustable attachment 204 including a ladder lock hardware 240 and barrel lock assembly 250 as shown in FIG. 6.

Figure 7:
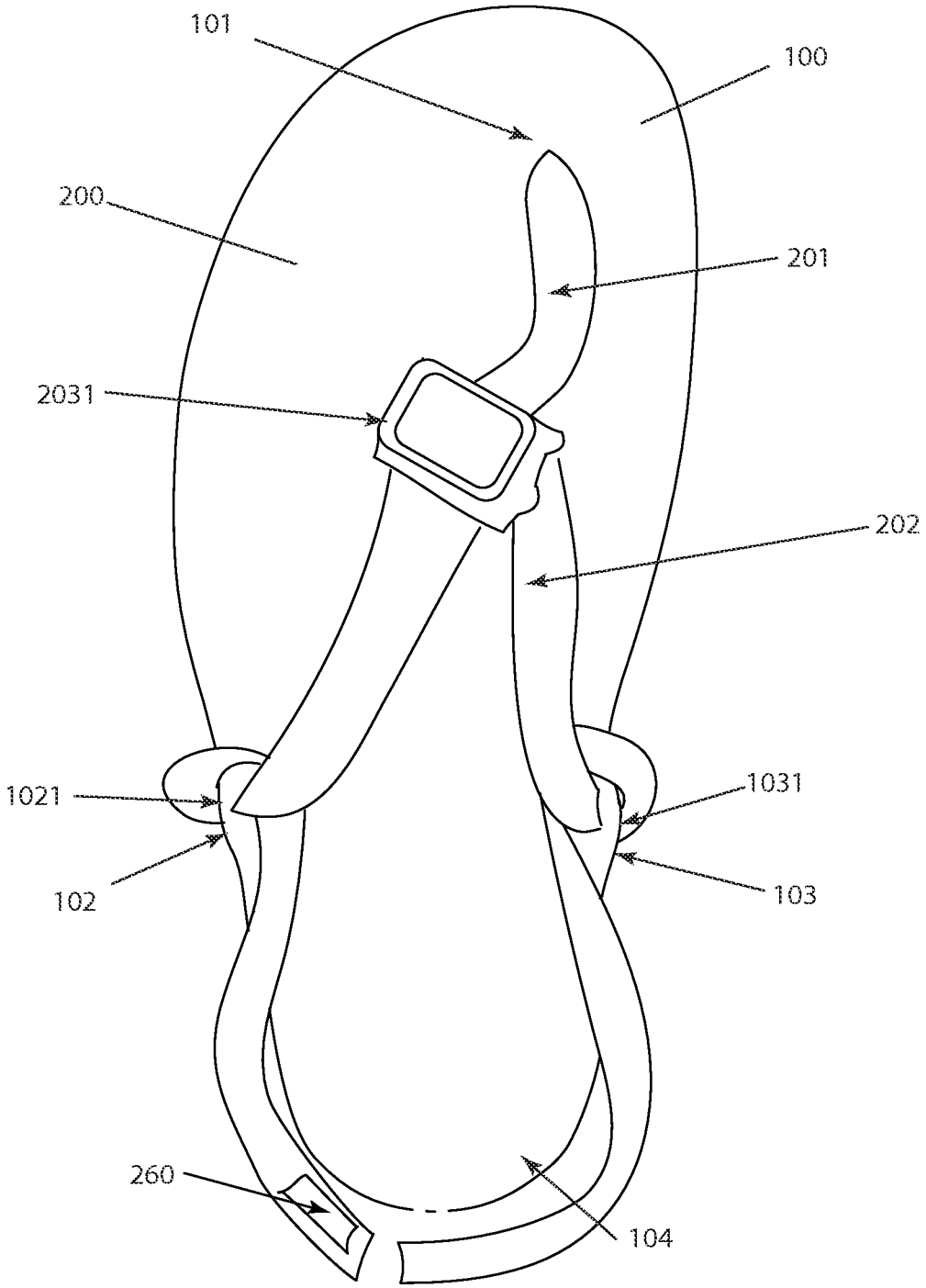
FIG. 7 illustrates a top view of a sandal of the present invention having a hardware attachment and formed using webbing.
Figure 8:
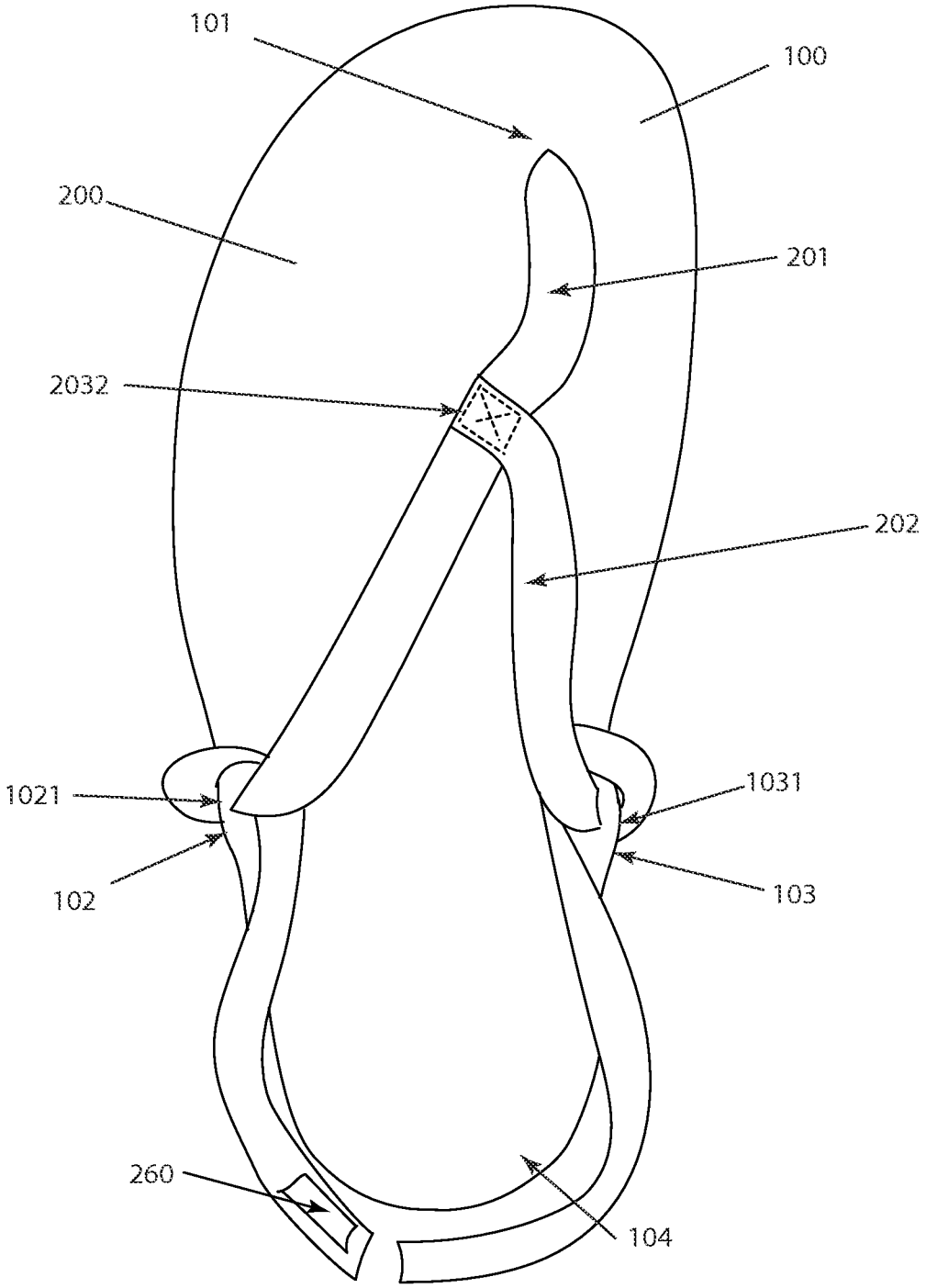
FIG. 8 illustrates a top view of a sandal of the present invention formed using webbing and having a sewn strap attachment point, and, FIG. 9 illustrates the sandal fit on the user's foot.

FIGS. 7 and 8 show an embodiment using substantially flat webbing to form straps 201 and 202. FIG. 7 includes hardware 2031 to form sliding attachment point 203 and FIG. 8 shows the attachment point 203 formed by sewing second strap 202 to the first strap portion 201. Tension may be adjusted using hook and loop fastener 260.

Figure 9:
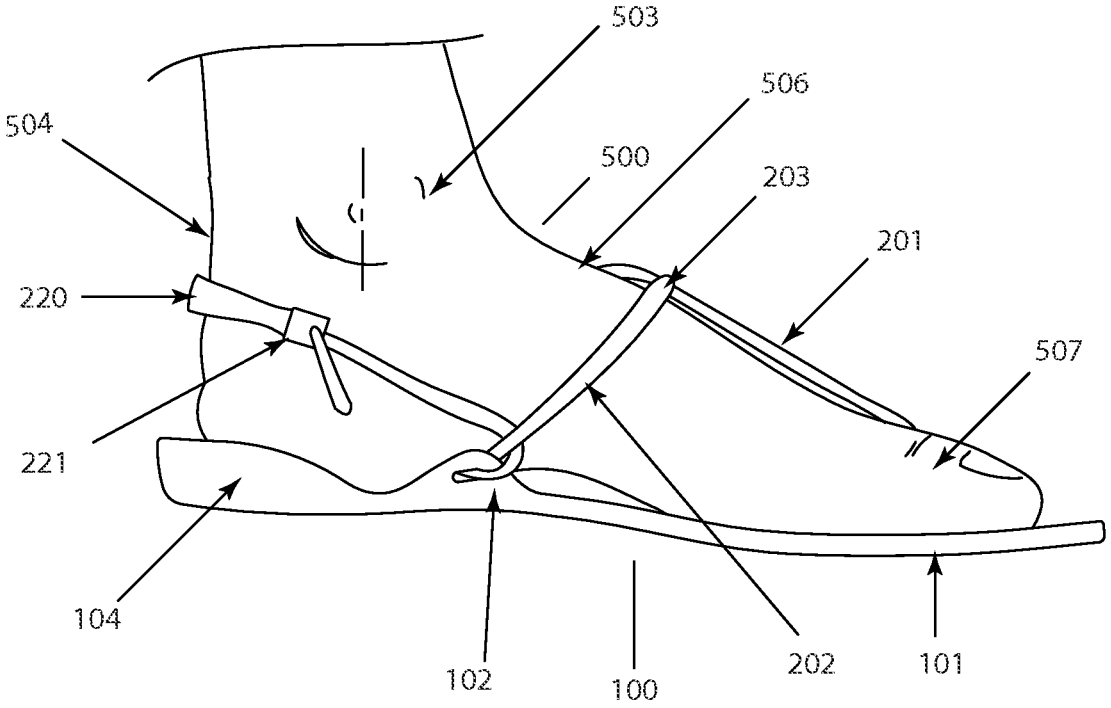

FIG. 9 is one embodiment of the present invention (FIGS. 2 and 3) demonstrating fit on a user's foot 500. Sole 100 including a toe strap attachment hole 101, a medial side attachment tab 102 and a heel cup 104. The first strap 201 is attached to sole 100 at point 101 and extends between the first toe 507 and the second toe (not shown) toward metatarsal portion 506 of the user's foot 500. The first strap 201 is attached to the sole at the lateral side attachment tab 103 and extended toward the heel cup 104. The second strap 202 is attached to the first strap 201 at attachment point 203 and then extended to, and laced through, medial side attachment tab 102. The free end of the second strap 202 is attached to independent heel strap piece 220 using hardware 221. The free end of the first strap is attached to independent heel strap 220 using hardware 222. Once in place the fit and location of heel strap 220, and hardware 221 and 222, can be adjusted in relationship to the user's Achilles 504 and ankle bone 503 for improved comfort.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A sandal comprising;

a sole having, a top surface, a bottom surface, an edge surface, a forefoot portion, a heel cup portion, a lateral side strap attachment tab having a hole, a medial side strap attachment tab having a hole, a toe strap attachment hole formed in formed in the forefoot portion, proximate the location of the gap between a users' first and second toes, a first support strap having a first end connected to the toe strap attachment hole, a running portion and, a second end extended toward the lateral side strap attachment tab and connected to the sole by inserting the second end through the hole from the top surface to the bottom surface, the second end routed from the bottom surface, over the edge surface, around the running portion of the first support strap and extended toward the heel cup, a second support strap having a first end connected to the first support strap between the connection points of the first support strap to the sole at the toe strap attachment hole and the lateral side strap attachment tab proximate a users' metatarsal region, a running portion, and a second end extended toward the medial side strap attachment tab and connected to the sole by inserting the second end through the hole from the top surface to the bottom surface, the second end routed from the bottom surface, over the edge surface, around the running portion of the second support strap and extended toward the heel cup, and, the second end of the first support strap adjustably connected to the second end of the second support strap posterior to the medial side strap attachment tab.

2. The sandal of claim 1 wherein the first end of the second support strap is connected to the first support strap in an adjustable manner.

3. The sandal of claim 2 wherein the adjustable manner include one of, a knot, a loop and hardware.

4. The sandal of claim 1 wherein the first end of the second support strap is connected to the first support strap in a fixed position.

5. The sandal of claim 4 wherein the connection is one of sewn, fused, and hardware.

6. The sandal of claim 1 wherein the adjustable connection between the second end of the first support strap and the second of the second support strap is an overlap connection wherein the second end of the first support strap is connected to the second support strap and the second of the second support strap is connected to the first support strap.

7. The sandal of claim 6 wherein the second end of the first support strap is connected to the second support strap and the second end of the second support strap is connected to the first support strap using a knot.

8. The sandal of claim 6 wherein the second end of the first support strap is connected to the second support strap and the second end of the second support strap is connected to the first support strap using a ladder lock hardware.

9. The sandal of claim 8 including an elastomeric tubular heel cushion installed over the overlapping portions of second end of the first support strap and the second end of the second support strap.

10. The sandal of claim 1 wherein the adjustable connection between the second end of the first support strap and the second of the second support strap includes a heel strap having connection hardware attached at a first end and a second end, the second end of the first support strap attached to the connection hardware of the first end, and, the second end of the second support strap attached to the connection hardware of the second end.

11. The sandal of claim 1 wherein the adjustable connection between the second end of the first support strap and the second of the second support strap is one of a barrel-lock and a ladder-lock.

12. The sandal of claim 1 including a pre-formed toe-post inserted in the toe-post attachment hole.

* * * * *